US006000914A

United States Patent [19]

Eppli et al.

[11] Patent Number: 6,000,914

[45] Date of Patent: Dec. 14, 1999

[54] ROTARY VANE CELL PUMP HAVING A FRUSTRUM ORIFICE

[75] Inventors: Konrad Eppli, Kleindeinbach; Uwe Zellner, Iggingen, both of Germany

[73] Assignee: ZF Friedrichshafen AG, Friedrichshafen, Germany

[21] Appl. No.: 08/973,687

[22] PCT Filed: Jun. 7, 1996

[86] PCT No.: PCT/EP96/02484

§ 371 Date: Dec. 12, 1997

§ 102(e) Date: Dec. 12, 1997

[87] PCT Pub. No.: WO97/00380

PCT Pub. Date: Jan. 3, 1997

[30] Foreign Application Priority Data

Jun. 14, 1995 [DE] Germany ..... 195 21 635

[51] Int. Cl.[6] ..... F04B 49/08

[52] U.S. Cl. ..... 417/300; 417/310

[58] Field of Search ..... 417/300, 310

[56] References Cited

U.S. PATENT DOCUMENTS

| | | | |
|---|---|---|---|
| 3,385,220 | 5/1968 | Dymond | 417/300 |
| 3,989,414 | 11/1976 | Rieber et al. | 417/300 |
| 4,207,038 | 6/1980 | Strikis | 481/75 |
| 4,298,316 | 11/1981 | Strikis | 417/310 |
| 5,209,648 | 5/1993 | Ishizaki et al. | 417/310 |

*Primary Examiner*—Charles G. Freay
*Assistant Examiner*—Robert Z. Evora
*Attorney, Agent, or Firm*—Larson & Taylor

[57] ABSTRACT

A vane cell pump with a flow regulating valve (13), upon whose regulating piston (17) the outlet pressure and a spring force act on one side. Between a pressure chamber (1) and an outlet channel (19), an orifice (14) is provided in the control plate (7), the orifice having a frustum protruding into the pressure chamber. The frustum brings about a flow rate dependent on the pump rpm, which flow in the outlet channel (19) acts upon the face end of the regulating piston (17).

6 Claims, 1 Drawing Sheet

ROTARY VANE CELL PUMP HAVING A FRUSTRUM ORIFICE

BACKGROUND OF THE INVENTION

1. Field of the Invention

The invention relates to a vane cell pump having a cam ring, supported in the housing, and a rotor with radial slots that is drivable by a drive shaft. Inserted into the radial slots are work slides that sealingly slide radially along in the cam ring. Between the cam ring, the rotor and the work slides, work chambers are formed that are defined in the axial direction by control plates. Built into the housing is a flow regulating valve, acted upon on one side by the delivery pressure against a spring force, which carries oil from a pressure chamber into a spray channel. A further orifice is also provided from the pressure chamber to an outlet channel.

2. Brief Description of the Invention

One such pump is known for instance from German Patent Application DE-A 41 08 126. In the control plate of this pump, an orifice with an orifice insert is provided between the pressure chamber and the outlet channel. This orifice brings about a descending characteristic curve of the flow rate over the rpm. In many cases, however, it is desirable to achieve a constant flow rate characteristic curve, for instance for use in power steering systems.

3. Summary of the Invention

The object of the invention is to attain a horizontal course of the characteristic curve. This object is attained by the characteristic features of the invention. The orifice seated in the outlet channel has a frustum flat face oriented toward the pressure chamber. By means of the frustum flat face, the inflow of oil into the orifice is varied in such a way that the desired constant, horizontal characteristic curve results. By means of the length of the orifice, a viscosity dependency is also attained, and as a result better cold-starting performance of the pump is obtained.

Brief Description of the Drawings

The invention is described in further detail below in conjunction with the drawings shown are.

DETAILED DESCRIPTION OF THE PREFERRED EMBODIMENTS

Figures 1, 2:
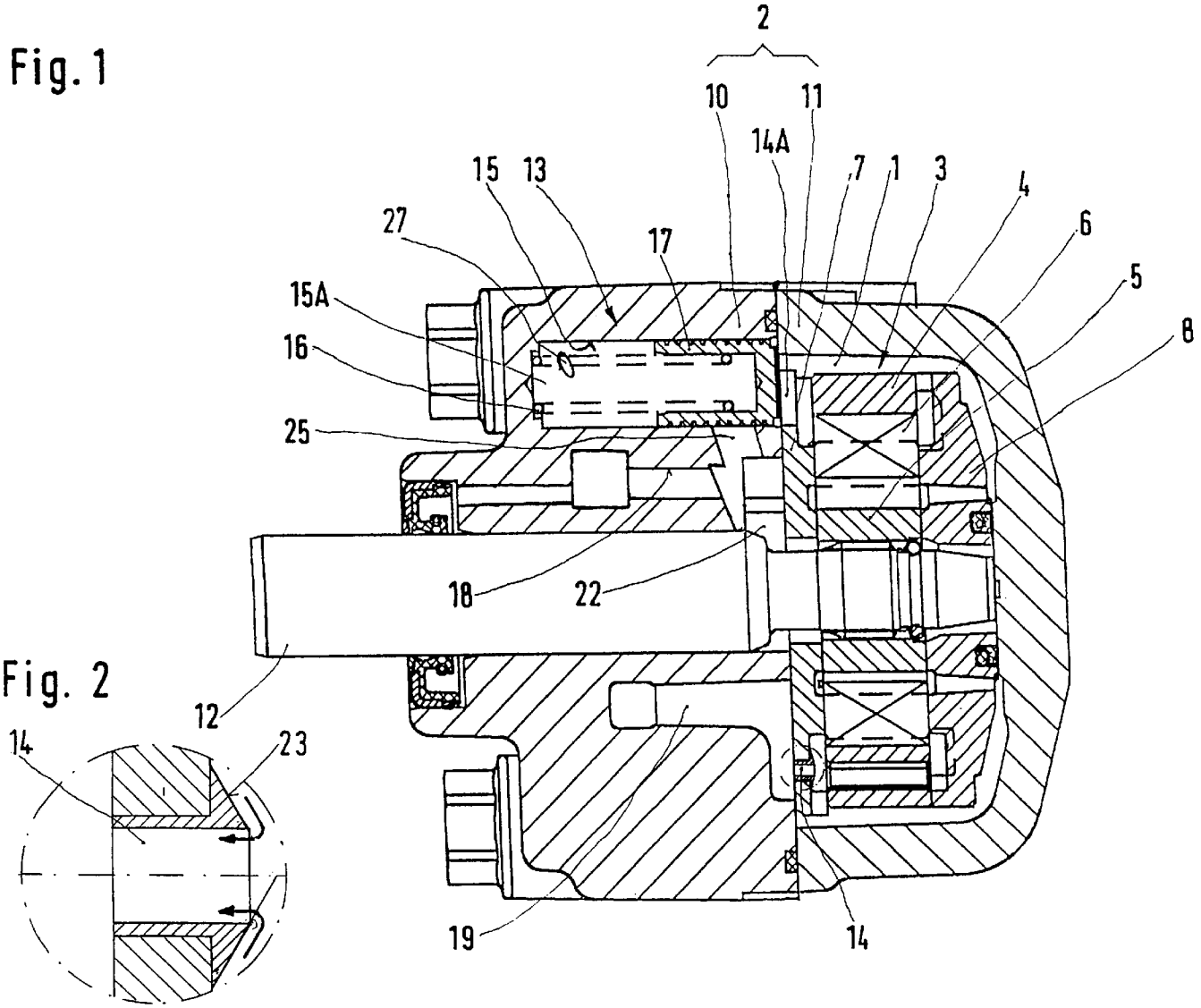
FIG. 1, a longitudinal section through a vane cell pump according to the invention.
FIG. 2, the flat face of the orifice on a larger scale.

The vane cell pump is used to feed pressure fluid in the form of oil from a container, not shown, to a consumer, not shown, for instance for a power steering system. In the drawing, a rotor set 3 is inserted into an oil-filled pressure chamber 1 of a housing 2. The rotor set 3 comprises a cam ring 4 and a rotor 5. The rotor 5 is disposed in the interior of the cam ring 4 and has radially oriented slots in which vanes 6 can be displaced. Between the cam ring 4, the rotor 5 and the vanes 6, work chambers are formed which are defined in the axial direction by control faces of adjacent control plates 7 and 8. The pump is embodied as a double-stroke version.

The housing 2 is composed of a bearing housing 10 and an end-loaded housing cap 11. The rotor 5 is seated in a manner fixed against relative rotation on a drive shaft 12 that is supported in the bearing housing 10. The bearing point in the bearing housing 10 is the sole bearing of the drive shaft 12. This means that the drive shaft 12 is not supported in the radial direction in the housing cap 11. The drive shaft is instead supported in the axial direction on the housing cap 11.

Along with an intake connection, not shown, for connecting the container and a pressure connection, also not shown, for the consumer, a flow regulating valve 13 for regulating the pressure fluid carried to the pressure connection is provided in the bearing housing 10. The embodiment of the flow regulating valve 13 and of a pressure limiting valve, also present but not shown, is well known, for instance from U.S. Pat. No. 5,098,259 and will therefore not be described in further detail here. The pressure channels that connect the work chambers to the flow regulating valve 13 and the pressure limiting valve are also disposed in the bearing housing 10. These pressure channels are also well known and will therefore not be described in detail.

According to the invention, the control plate 7 has an orifice 14 with a frustum flat face 23. The frustum flat face 23 is embodied such that a convex frustum, which surrounds the orifice 14, protrudes from the control or pressure plate 7 into the pressure chamber 1. The flat face 23 prevents an rpm-dependent outflow in the orifice 14 and acts in a sense as a variable orifice. The higher the flow velocity, the lower the flow quantity. This effect is obtained in that the outflow of the pressure chamber 1 into the orifice 14 is deflected more markedly by the frustum flat face 23. As the flow velocity rises, there is a decrease in the hydraulic cross section at the entrance into the orifice. The orifice 14 and an aperture 14A communicate with the pressure-bearing work chambers formed between the rotor 5, the cam ring 4 and the vanes 6. The delivery pressure prevails in the pressure chamber 1. The delivery pressure is delivered to the consumer via the orifice 14 and the outlet channel. A piston bore 15 of the flow regulating valve 13 axially adjoins the aperture 14A. The piston bore 15 contains a regulating piston 17, against which a spring 16 inserted into the spring chamber 15A presses. The piston bore 15 communicates with an inlet 22 via a spray channel 25. The piston bore 15 also communicates via a hole 27 with the outlet channel 19. The flow regulating valve 13 functions as follows:

As the rpm rises, the differential pressure because of the orifice 14 on the end face toward the aperture 14*a* of the regulating piston 17 increases. The regulating piston 17 acts as a piston manometer and is displaced to the left, counter to the force of the spring 16 and counter to the force of the outlet pressure prevailing downstream of the regulating piston 17. The end face of the regulating piston 17 then opens the spray channel 25. A partial flow thus returns in a known manner to the inlet side of the pump. A useful horizontal flow characteristic curve is thus obtained.

The frustum flat face 23 may alternatively be embodied as a variable insert with various orifice diameters and lengths and taper angles. Moreover, the orifice taper may be integrated into the control plate.

We claim:

1. In a vane cell pump having the following characteristics:

a cam ring is supported in a housing;

a rotor drivable by a drive shaft has radial slots, and work slides which are inserted into the radial slots and which slide sealingly along the cam ring;

work chambers formed between the cam ring, the rotor and the work slides, and first and second central plates defining the work chambers in the axial direction;

a flow regulating valve, acted upon on one side by a delivery pressure and on the other side by an outlet pressure plus a spring force, is built into the housing and carries oil from a pressure chamber to a spray conduit;

an orifice is present in the first control plate located between the pressure chamber and an outlet channel;

the improvement comprising the orifice in the first control plate has a frustum flat face oriented toward the pressure chamber, and forming a convex frustum, which surrounds the orifice and, protrudes into the pressure chamber.

2. The improved vane cell pump as claimed in claim 1, wherein said convex frustum in axial cross section is angle shaped to come to a pointed tip.

3. The improved vane cell pump as claimed in claim 2, wherein the frustum flat face extends from a face of the first control plate.

4. The improved vane cell pump as claimed in claim 1, wherein the orifice includes an insert which is inserted into the first control plate.

5. The improved vane cell pump as claimed in claim 1, wherein the orifice has a constant diameter.

6. The improved vane cell pump as claimed in claim 1, wherein the frustum flat face extends from a face of the first control plate.

* * * * *